United States Patent [19]

Meylan

[11] 4,199,301

[45] Apr. 22, 1980

[54] HOUSING FOR THERMAL APPARATUS AND FLUID FLOW MACHINES PARTICULARLY A STEAM TURBINE

[75] Inventor: Pierre Meylan, Neuenhof, Switzerland

[73] Assignee: BBC Brown Boveri & Company Limited, Baden, Switzerland

[21] Appl. No.: 818,333

[22] Filed: Jul. 22, 1977

[30] Foreign Application Priority Data

Aug. 13, 1976 [CH] Switzerland ..... 10318/76

[51] Int. Cl.[2] ..... F01D 25/24

[52] U.S. Cl. ..... 415/201; 415/219 R

[58] Field of Search ..... 415/118, 201, 126, 219 R; 290/52; 248/240, 240.1, 240.4; 296/57 R, 58, 66; 165/75, 76, 77; 123/198 E, 195; 244/129.6; 108/99, 108; 182/82, 91, 129, 134; 60/646, 657; 14/71

[56] References Cited

U.S. PATENT DOCUMENTS

| | | | |
|---|---|---|---|
| 1,001,946 | 8/1911 | Gumm | 182/82 |
| 1,322,222 | 11/1919 | Baumann | 415/219 R |
| 1,695,609 | 12/1928 | Richter | 296/57 R |
| 1,836,453 | 12/1931 | DeVeau et al. | 14/71.1 |
| 1,986,953 | 1/1935 | Wendel | 296/57 R |
| 2,042,911 | 6/1936 | Stannard | 296/57 R |
| 2,432,055 | 12/1947 | Watter et al. | 296/57 R |
| 2,653,845 | 9/1953 | Benjamin | 296/57 A |
| 2,951,454 | 9/1960 | Candlin, Jr. | 244/129.6 |
| 3,567,274 | 3/1971 | Kaptur, Jr. et al. | 296/57 R |
| 3,945,760 | 3/1976 | Miller | 415/201 |
| 4,026,351 | 5/1977 | Biaua | 165/75 |

*Primary Examiner*—Louis J. Casaregola

*Attorney, Agent, or Firm*—Burns, Doane, Swecker & Mathis

[57] ABSTRACT

A housing structure for a steam turbine includes inner and outer housings and a hinged portion of one of those housings is structured for being lowered or raised into a horizontal plane to serve as a working platform to facilitate servicing. The hinged housing portion includes a hinged upstanding rim to prevent tools from sliding off and a protective railing is secured to the rim.

4 Claims, 8 Drawing Figures

HOUSING FOR THERMAL APPARATUS AND FLUID FLOW MACHINES PARTICULARLY A STEAM TURBINE

FIELD OF THE INVENTION

The present invention relates to an improvement in the structure of a housing component of thermal apparatus and fluid flow machines and particularly a steam turbine, comprising an inner and an outer housing as well as pipes to supply and discharge the operating fluid medium.

BACKGROUND OF THE INVENTION

In order to keep the time periods for inspection of thermal apparatus and particularly a steam turbine to a minimum, i.e., to ensure brief shutdown times for a plant, it becomes necessary to design individual parts especially housing parts of the turbines in such manner that they will specifically facilitate any servicing. Heretofore, mounting platforms or cover grills were used for inspection and repairs of the turbine at the plant location and assembled in accordance with the structural conditions at the working site or of the plant. In different cases an access plate or grill was supplied by the manufacturer to be utilized when needed, that is for the original assembly or inspection after the removal of the outer turbine housing. Such mounting platforms had again to be removed from the turbine upon the completion of the inspection or repair.

SUMMARY OF THE INVENTION

It is the principal object of this invention to provide a housing containing devices which will make unnecessary the erection of a mounting platform, which need not be dismantled upon the completion of the inspection or repair and which will help to reduce substantially the shutdown time periods of a plant.

The invention solves this problem in that manner that one portion of the housing is hinged and can be lowered or raised into the horizontal plane and forms a working platform.

In accordance with a preferred embodiment of the invention one portion of the inner housing, as well as one portion of the outer housing, of a steam turbine can be lowered or raised into the above defined position.

The construction proposed by the invention has the advantage that the hinged housing portions become structurally integrated with the inner or outer housing of the turbine. During normal operation these coverings, for example, the outer coverings, are hinged at the inner walls of the turbine housing and will thus not interfere with fluid flow. When inspections or repairs become necessary, the bolts holding the coverings in place can be detached, and the covering portions can be lowered or raised into a horizontal position. It will be advantageous for this purpose to provide these portions with a hinge at one end while they are being held at their other end in the horizontal position by means of chains, to give an example. Since these hinged portions are relatively large and heavy, they are lowered, or raised respectively, by means of pulleys which are available and in fixed position at practically all turbine plants. The hinged portions, serving as working platforms, are immediately accessible to service personnel when brought into the horizontal position. Furthermore, when the portions are restored to their original vertical or nearly vertical position, the turbine is then immediately in running order again, with no need to remove auxiliary components from the turbine. This is particularly advantageous when turbines are installed in systems employing boiling water reactors because there will be no need for any decontamination measures.

In a further development of the invention, the hinged housing portions are limited by a rim and means are provided to accommodate a guard rail.

The placement of an upwardly directed rim, bordering the hinged housing portions, and the arrangement of receptacles for the placement of a guard rail will prevent tools or materials from falling into the condenser, located a few meters below, by sliding off the working platform, and the insertion of a guard rail into receptacles, for example, pipe stubs welded to the rim, will reduce substantially the danger of accidents involving personnel working at the platform. It is also feasible to design the guard rail in such manner that it will become an integral part of the covering, i.e., by folding this rail prior to restoring the platform to the initial position in such manner that it becomes located inside the upwardly directed rim.

It is also possible and expedient to design the hinged housing portion as a covering for an access hatch and to utilize its rim as a seal support.

This specific arrangement will be advantageous in all instances where a hinged portion of the outer housing of the turbine can be lowered or raised so that a wide opening can be provided at the turbine, thereby improving substantially the accessibility to the inner jacket and to the blading of a fully assembled turbine. In this case it is also possible to make the area of the hatch opening smaller than the area of the hinged portion of the outer housing.

BRIEF DESCRIPTION OF THE DRAWINGS

In the accompanying drawings which illustrate, in a simplified manner, preferred embodiments of the invention.

DETAILED DESCRIPTION OF PREFERRED EMBODIMENTS

Figure 1:
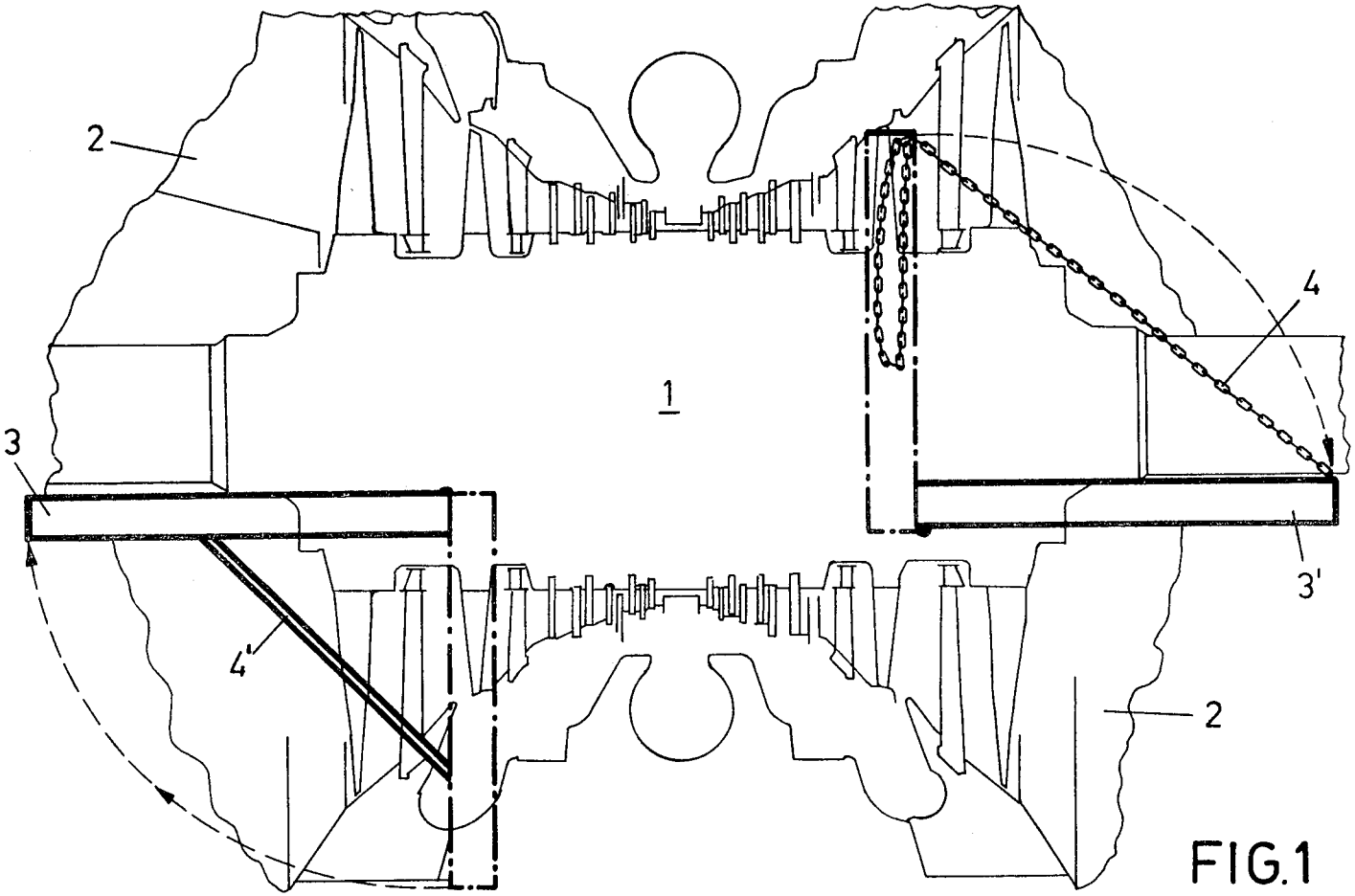
FIG. 1 shows a longitudinal axial vertical section of a dual flow type steam turbine with portions of the inner housing that can be lowered or raised.
Figure 2:
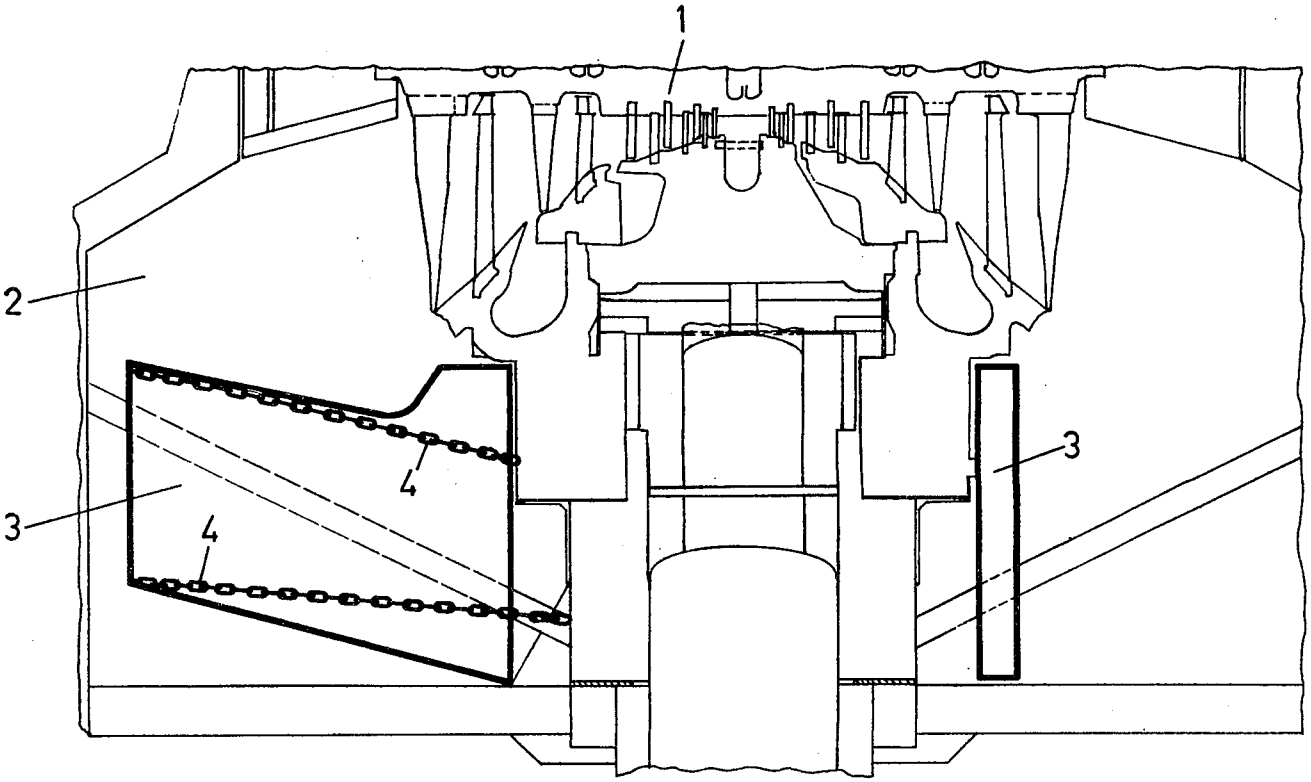
FIG. 2 is a plan view of the turbine shown by FIG. 1.
Figure 3:
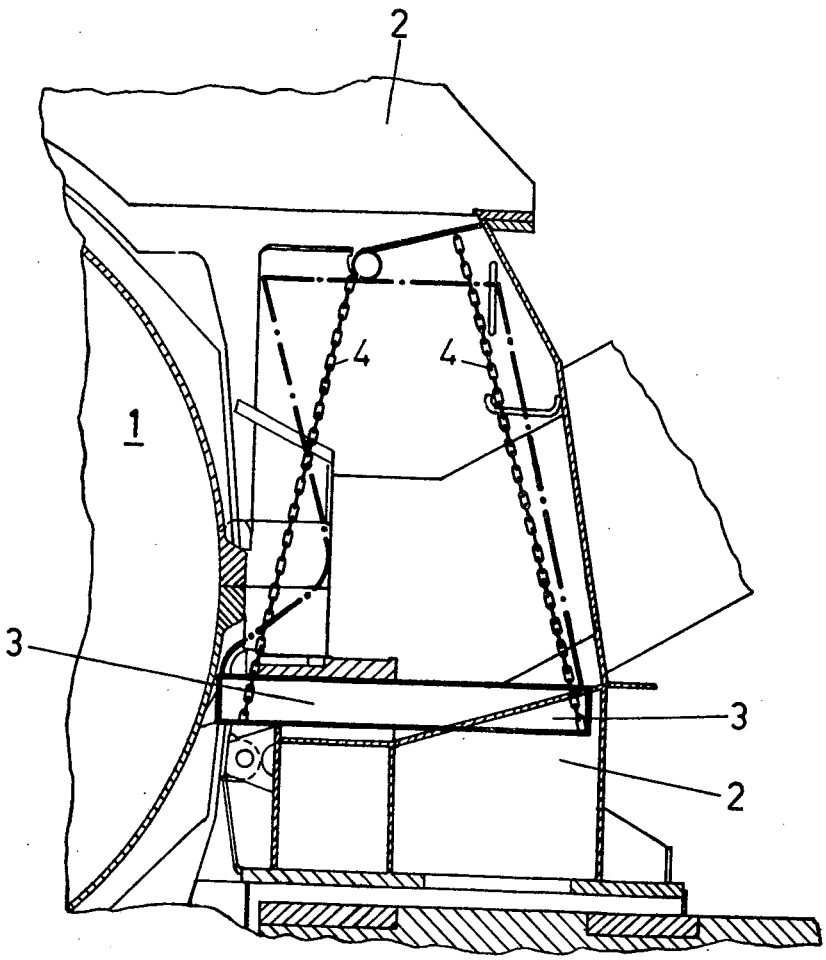
FIG. 3 is a vertical transverse sectional view of a portion of the turbine shown by FIG. 1.

Numeral 1 in FIGS. 1, 2, and 3 denotes a dual flow, i.e., a center intake turbine which is surrounded by a housing 2. Housing parts 3 and 3' of housing 2 are designed in such manner that they can be lowered or raised along a hinge line from a vertical closed position into a horizontal open position so that they can be utilized as working platforms for inspections and repairs.

FIG. 1 shows the housing part 3' lowered from its upper vertical position into its lower horizontal position (heavy lines), with the initial, upright position indicated by dots and dashes. The housing part 3 is raised from its initial lower vertical position to its upper horizontal position and properly secured in the working-platform position. The housing parts 3, 3' are held in place at their working-platform positions by suspension means, for example, by chains 4 or struts 4'. When the housing parts 3, 3' are moved back, the suspension means can either be removed or be secured within the associated housing part 3 or 3' as illustrated in FIG. 1 so that they will not impede the turbine flow.

Figure 4:
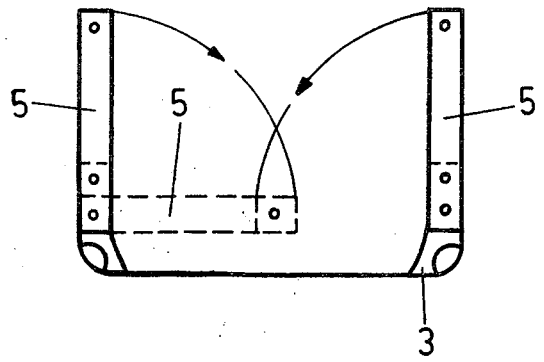
FIG. 4 is a detail of the cover with fold-down guard rail.

FIG. 4 provides a detailed view of the housing part 3, with railings 5 arranged at the outer contours in such manner that they can be folded inwardly. The broken lines indicate the position of the railing 5 in the folded-down state.

Figure 5:
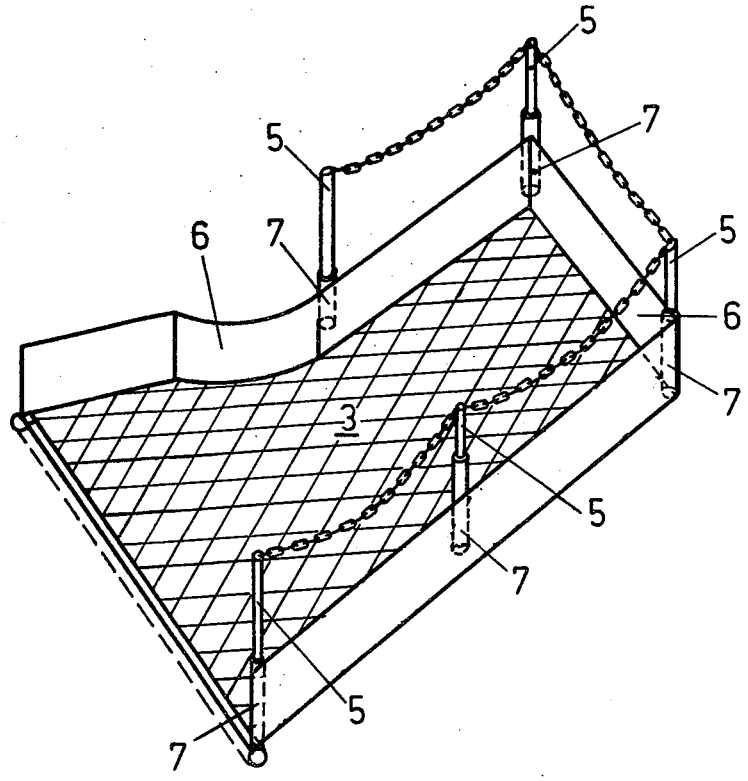
FIG. 5 shows in perspective the working platform with the guard rail inserted.

The perspective view of the housing part 3 in FIG. 5 illustrates the rim 6 which closes off this part for reasons of safety as well as the receptacles 7, for example, in the form of pipe stubs which are welded on and into which the railings 5 can be inserted.

Figure 6:
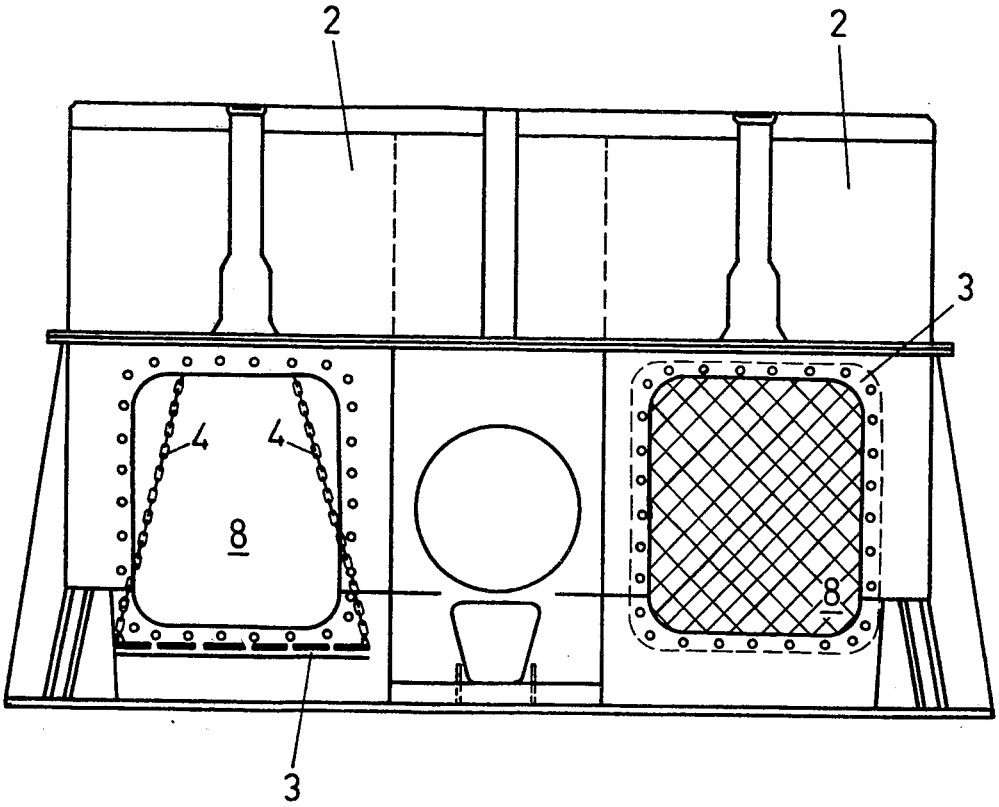
FIG. 6 shows in elevation one construction of a turbine's outer housing with access hatches and lowerable covering.

In the case of the embodiment shown by FIG. 6 the housing 2 forms one part of the outer turbine housing and is provided with two access spaced hatches 8 which are covered toward the outside by means of the hinge-mounted housing parts 3. This figure shows the access hatch 8 at the left in the open position, i.e., the housing part 3 is lowered inwardly and down and held in place by the suspension chains 4 while the access hatch at the right is covered over by the housing part 3.

Figure 7:
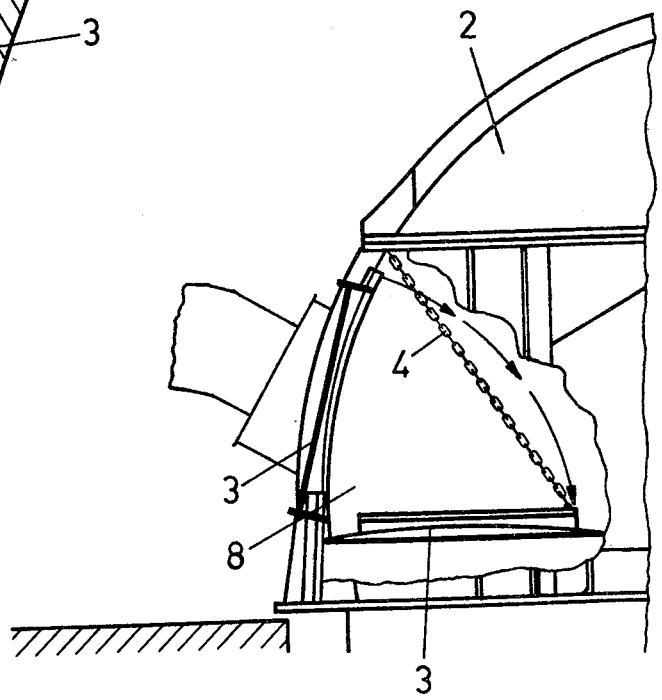
FIG. 7 is a side view of the turbine housing illustrated by FIG. 6.

FIG. 7 provides a partial view of the housing structure depicted in FIG. 6, this view showing one of the access hatches 8 in the housing 2, and the hinge-mounted housing part 3 which has an arcuate surface matching that of housing 2 and which is lowered inwardly and downwardly about its hinge axis in the direction of the arrow to its horizontal position providing the desired working platform. The housing part 3 is held in that position by chains 4 and includes a planar plate 12 to be walked on by servicing personnel.

Figure 8:
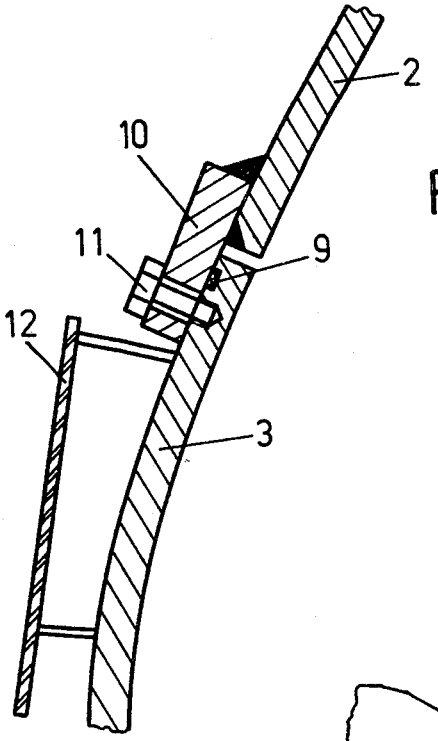
FIG. 8 shows a sealing arrangement at an enlarged scale where the hinged housing portion forms a seal with the outer housing.

FIG. 8 is a detail, depicted at a larger scale of a portion of the hinged housing part 3 at the side opposite its hinge axis showing the manner in which it is secured in its raised position, i.e. as a cover over the hatch opening 8. A generally rectangular flange 10 matching that of the periphery of the housing part 3 is welded to the housing 2 and projects over the border of the hatch opening 8 so as to be engaged by the border portion of the housing part 3 when moved into the hatch-closing position as indicated in the drawing. A peripherally extending sealing strip 9 set into a recess in the outer surface of the housing part 3 is pressed into contact with the inner face of flange 10 and establishes a desired seal for the hatch as a peripherally extending series of bolts 11 which pass through openings in the flange 10 and thread into the housing part 3 are tightened.

The arrangement of the access hatch(es) 8 at the outer wall of the turbine housing structure greatly facilitates access to the inner housing and to the turbine blading with the turbine fully assembled and therefore there will be no need to remove large-sized sections of the outer housing. Obviously, if the housing parts 3 for covering the hatches 8 are lowered outwardly from the housing 2 to form the desired horizontal working platform rather than inwardly as depicted in FIG. 6-8, the seal 9 and flange 10 will have to be located at the inner surface of the housing part 3.

I claim:

1. A turbine housing comprising:

an outer housing;

an inner housing positioned within the outer housing;

means for supplying working fluid to the interior of said inner housing and for discharging working fluid therefrom;

horizontally hinged portions on each of the inner and outer housings, each portion having a first vertical position in which the portion forms an integral part of the corresponding housing and being movable to a second horizontal position for use as a working platform;

the hinged portion on the inner housing opening towards the outer housing when being moved to the second position and including sealing means and securing means on the outside of the inner housing for sealing the inner housing when the hinged portion is in the first position; and each of the hinged portions including means for maintaining each of the portions in the second horizontal position.

2. A turbine housing according to claim 1 wherein the outer housing is curved and the hinged portion on the outer housing includes a flat platform.

3. A turbine housing according to claim 1 wherein the means for maintaining each of the hinged portions in the horizontal position comprises a chain.

4. A turbine housing according to claim 1 wherein each of the hinged housing portions is provided with a guardrail.

* * * * *